United States Patent [19]

Dobrovolsky

[11] 4,064,728

[45] Dec. 27, 1977

[54] DEVICE FOR SELECTING SETS OF ROLLS FOR TWENTY-HIGH ROLLING MILL

[76] Inventor: Leonid Vasilievich Dobrovolsky, ulitsa 40 let Sovetskoi Ukrainy 7, kv. 25, Zaporozhie, U.S.S.R.

[21] Appl. No.: 779,523

[22] Filed: Mar. 21, 1977

[51] Int. Cl.[2] ..... B21B 31/08

[52] U.S. Cl. ..... 72/238; 33/1 G

[58] Field of Search ..... 72/238, 239, 243; 33/1 G

[56] References Cited

U.S. PATENT DOCUMENTS

| | | | |
|---|---|---|---|
| 2,883,764 | 4/1959 | Stephens | 33/1 G |
| 3,147,648 | 9/1964 | Sendzimir | 72/243 X |

*Primary Examiner*—Milton S. Mehr

*Attorney, Agent, or Firm*—Lackenbach, Lilling & Siegel

[57] ABSTRACT

A device, for selecting sets of rolls for twenty-high rolling mill, comprising a flat board, whereupon eccentric disks are mounted in full conformity with the positioning of the backup rolls of a rolling mill, dimensions of said disks corresponding to the dimensions of the backup rolls of the rolling mill. Secured on the board is a vertical guide member, for displacement of disks corresponding to the working roll and second intermediate idle roll, and a horizontal bar corresponding to the passline of rolling mill, with respect to which the position of the working roll is determined. In addition, there are other disks which are installed on the board in compliance with the positioning in the rolling mill of the first intermediate and second intermediate drive rolls, thus forming a two-dimensional model of the roll arrangement in the rolling mill. The dimensions of rolls are selected by varying the position of the disks corresponding to the backup rolls so as to provide the required processing gap between the working rolls of the rolling mill.

2 Claims, 2 Drawing Figures

DEVICE FOR SELECTING SETS OF ROLLS FOR TWENTY-HIGH ROLLING MILL

The present invention relates to cold rolling of metals, and more particularly to devices for selecting sets of rolls for twenty-high rolling mills.

The proposed invention may find application in the practice of operating rolling mills and at the stage of designing thereof.

At present, rolling of thin steel strips is effected on multiroll mills whose best prior-art models incorporate 20 rolls.

The rolls of a rolling mill are arranged in a shaped boring of the housing which is machined at high accuracy.

In the process of rolling the rolls of said mill wear out which necessitates their replacement. It is important, therefore, that a set of rolls be always at hand for timely replacement. When selecting sets of rolls, it should be borne in mind that rolls of a diameter larger than that which is required will not fit into the boring of the housing, whereas working rolls with smaller diameters cannot be arranged so as to be in contact with each other, thus rendering the rolling of metal strips impossible. It is also probable that in the event of wrongly matched roll diameters, the gap between the working rolls will be substantially smaller than the thickness of a blank and the latter cannot be fed into the rolls. Thus, the proper selection of sets of rolls under production conditions is made difficult and erroneous selection thereof will cause a loss of production time for appropriate corrections, i.e., the roll replacement operations will have to be repeated.

It is an object of the present invention to obviate the above-mentioned difficulties in the selection of sets of rolls for twenty-high mills.

It is another object of the present invention to provide a device which would make the selection of rolls easier.

Said objects are accomplished by a device for selecting sets of rolls for twenty-high rolling mills, according to the invention, comprising a flat board which carries eccentric disks rotatably mounted in the plane thereof and arranged in conformity with the layout of backup rolls of the rolling mill, the dimensions of said disks corresponding to those of the backup rolls of the rolling mill, the board carrying a vertical guide member for the disks corresponding to the working roll and second intermediate idle roll to move therealong, and a horizontal bar corresponding to the pass line of the rolling mill, said line being a reference one for positioning the working roll, other disks being located on the board in conformity with the layout of the first intermediate roll and second intermediate drive roll, thus forming a two-dimensional model imitating the layout of mill rolls. Thereby the position of the disks corresponding to the backup rolls is adjusted so as to match the dimensions of the remaining rolls and obtain the required gap between the working rolls of the rolling mill.

It is expedient that one-fourth of the two-dimensional model of the roll layout be made use of for selection of rolls.

The device of the invention is capable of:

selecting optimum dimensions of the rolls included in a set which would provide the maximum gap between working rolls with a possibility of the rolls being set in contact with each other;

determining the gap between the working rolls for any diameter of the rolls included in a set;

determining the maximum and minimum diameters of the working rolls which allow the rolling process to be practised, without altering the diameters of the remaining rolls included in a set; and selecting the dimensions of the corresponding rolls of top and bottom trains with maximum possible size tolerances within the permissible tolerance margin for the working rolls.

Designing offices where similar mills are developed may use such a model for selecting the best locations of the centers of baring in the borings in the housing and for analyzing all possible magnitudes of roll diameters and all possible variants of the critical position of the rolls when they contact each other.

The invention will be more clearly understood from the following description of its practical embodiment with reference to the accompanying drawings, wherein.

Figure 1:
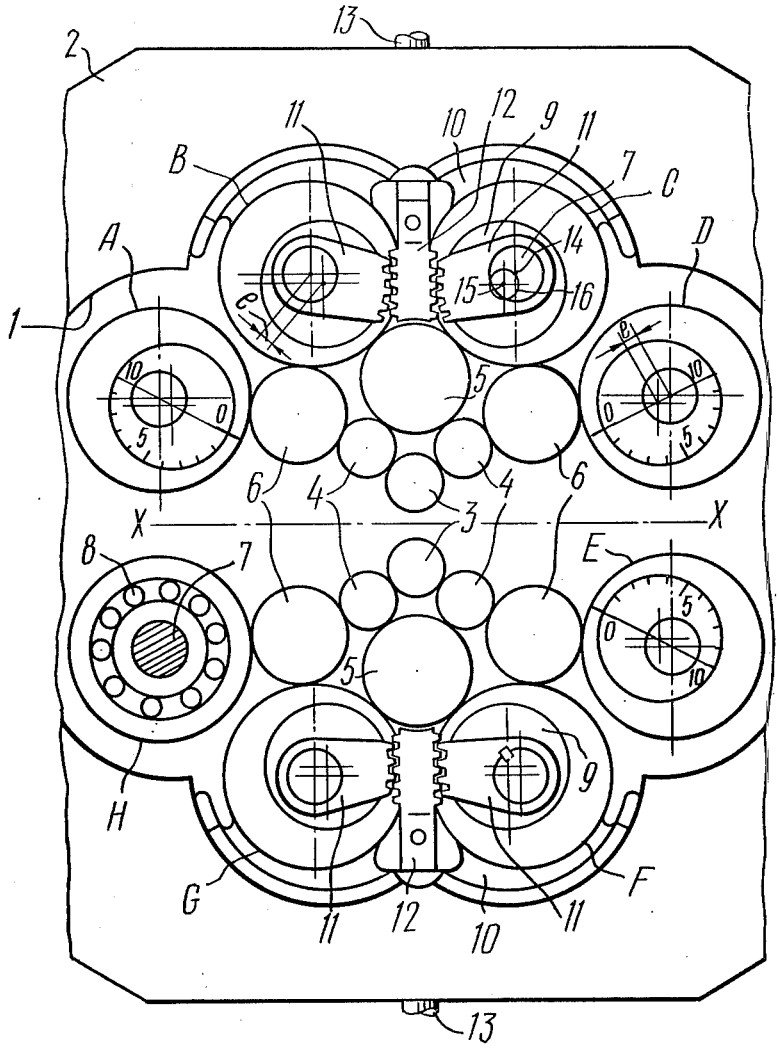
FIG. 1 is a schematic layout of the rolls of a rolling mill.

For a better understanding of the essence of the present invention, FIG. 1 illustrates schematically the layout of a twenty-high mill.

The roll system of a rolling mill, arranged in a borehole 1 (FIG. 1) of a housing 2, comprises two working rolls 3, four first intermediate rolls 4, six second intermediate rolls, of which two rolls 5 are idle and four rolls 6 are drive ones, and eight backup rolls A, B, C, D, E, F, G. H.

Each of the backup rolls is made as a steel axle 7 carrying bearings 8 which define the roll barrel.

Installed on the axle 7 between the bearings 8 are eccentric rings 9 featuring a definite amount of eccentricity. The eccentric rings 9 are key-fixed on the axles 7 and fitted in the bore-holes of the uprights of seats 10.

The ends of the axles of the backup rolls B, C, F, G carry toothed quadrants 11 rotatable by toothed racks 12 which are in mesh with the quadrants and are in effect the extension of rods 13 of the hydraulic power cylinders (not shown).

When turned, the toothed quadrants 11 cause the eccentric rings 9 to rotate, and a center 14 of the axle 7 rotates around a center 15 of the eccentric ring 9 along a circumference 16 whose radius is equal to the amount of eccentricity.

The position of the backup rolls B and C determines the position of the top working roll 3 in the bore and when the position of the two former rolls is changed the gap between the working rolls 3 is also varied in the course of rolling.

By varying the position of the backup rolls F and G, which are similar in design to the rolls B and C, the bottom working roll 3 is positioned on the pass line X.

The ends of the axles of the backup rolls A, H, D, E mount gears provided with a mechanism (not shown) for their turning through 180°, thus enabling the position of the roll train to be changed so as to displace the working rolls 3 and vary the gap therebetween. The roll train is a combination of ten top or bottom rolls.

Each pair of the backup rolls A–H and D–E is equipped with its own turning mechanism to change the position of the remaining rolls in the bore 1 and is intended to compensate for the diameter of these rolls after their having been reground.

All the rolls, except the backup ones, differ considerably in their maximum and minimum diameters.

Displacement of the top and bottom trains of rolls is insignificant and restricted by the housing bore-hole.

The surfaces of all rolls wear on when the twenty-high mill is operated for strip rolling, thus the need arises to replace them with reground rolls selected beforehand as to diameter to fit into the set of rolls.

When selecting sets of rolls it should be borne in mind that rolls with diameters larger than that which is required will not fit into the bore-hole of the housing, and working rolls with smaller diameters cannot be arranged so as to be in contact with each other thus rendering the rolling of strips impossible.

It is also probable that in the event of wrongly matched roll diameters, the gap between the working rolls will be substantially smaller than the thickness of a blank and the latter cannot be fed into the rolls.

Thus, the proper selection of sets of rolls under production conditions is made difficult and erroneous selection thereof will involve much labor.

Figure 2:
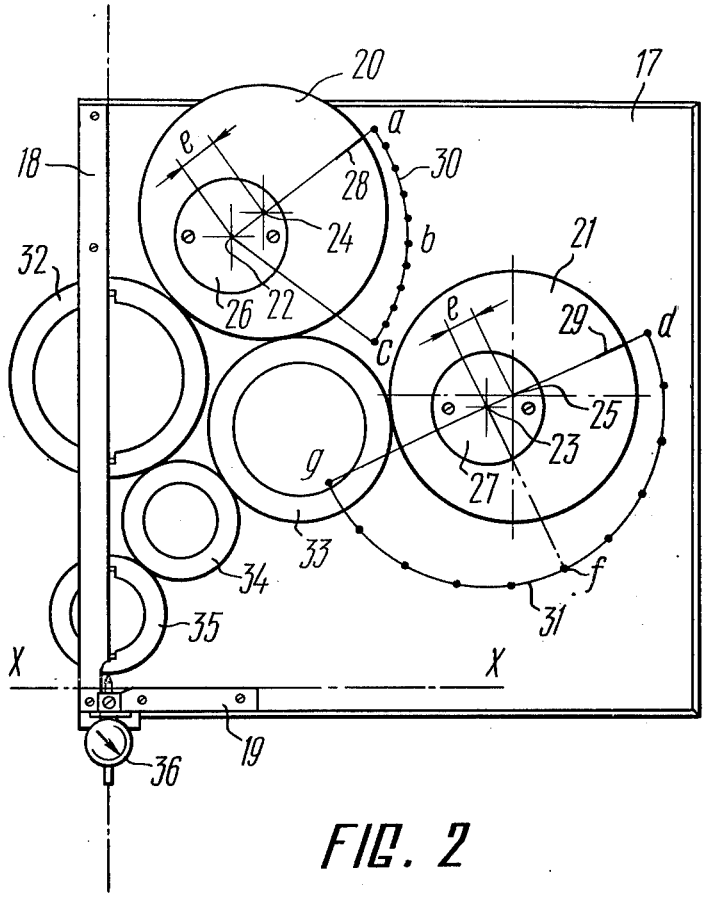
FIG. 2 is a plan view of the device for selecting sets of rolls for a twenty-high mill.

FIG. 2 illustrates a device for selecting sets of rolls to facilitate the process of selecting sets of rolls for twenty-high mills.

The device for selecting sets of rolls according to the invention is in effect a two-dimensional full-scale model of an one-fourth portion of the roll system of a twenty-high rolling-mill, and comprises a flat board 17 (FIG. 2) made from any readily machinable material.

Said flat board 17 is used as a base for mounting all the rest of the elements of the device.

Rigidly fixed on one side of the board 17 is a vertical guide member 18 so that a certain clearance is defined between the guide member 18 and the board 17. A horizontal bar 19 corresponding to the pass X (FIG. 1) of the rolling mill is fixed in position at right angles to the vertical guide member 18.

In addition, mounted on the board 17 (FIG. 2) rotatably in the plane thereof are eccentric disks 20 and 21 which are located on the board 17 in full conformity with the arrangement of the backup rolls C and D (FIG. 1) of the rolling mill, the dimensions of the disks 20 and 21 (FIG. 2) corresponding to the dimensions of the back-up rolls of the rolling mill.

The disks 20 and 21 can be made from any suitable material, such as metal sheeting.

The disks 20 and 21 have holes whose centers 22 and 23 are offset as to the centers 24 and 25 of the disks 20 and 21, respectively, by the amount of the eccentricity.

The disks 20 and 21 are rotatably mounted on round plates 26, 27 made of the same material as the disks 20 and 21 and fixed in place on the board 17. The disks 20 and 21 have respective marks 28 and 29 made on a common diameter of the disks 20, 21 and the plates 26, 27.

The amount of eccentricity "*e*" between the centers 22–24 and 23–25 of the disks 20, 21 fully corresponds to the amount of eccentricity of the backup rolls C and D (FIG. 1) of the rolling mill.

Provided on the board 17 (FIG. 2) close to the disks 20 and 21 are two scales 30 and 31 respectively, which together with the marks 28, 29 indicate the amount of displacement of the disks 20, 21 during their turning and, respectively, the amount of the gap between the working rolls 3 (FIG. 1) of the rolling mill.

Extreme graduations a and c, d and g, respectively, of the scales 30 and 31 correspond to the extreme positions of the backup rolls C and D respectively, during their rotation.

In addition, there is a set of disks whose dimensions correspond to the dimensions of the remaining rolls of the rolling mill.

Thus, a disk (FIG. 2) corresponds to the second intermediate idle roll 5 (FIG. 1), a disk 33 (FIG. 2) corresponds to the second intermediate drive roll 6 (FIG. 1), a disk 34 (FIG. 2) corresponds to the first intermediate roll 4 (FIG. 1), and a disk 35 (FIG. 2) corresponds to the working roll 3 (FIG. 1).

Provided for each type of rolls of the rolling mill are separate sets of disks whose diameters correspond to the diameters of rolls of the rolling mill from minimum to maximum, intermediate ones inclusive. The diameters of the disks combined in a set differ successively from each other by a certain increment value, such as 2 mm.

The disks 32, 33, 34, 35 (FIG. 2) are positioned on the panel 17 in full conformity with the disposition of their counterpart rolls 6, 5, 4, 3 (FIG. 1) on the rolling mill.

The disks 32 and 35 corresponding to the second intermediate idle and the working rolls 5 and 3 (FIG. 1), respectively, are mounted for their possible vertical displacement along the guide member 18 (FIG. 2). Displaceable similarly, i.e. vertically, are the rolls 5 and 3 of the rolling mill.

The disk 33 (FIG. 2) corresponding to the second intermediate drive roll 6 (FIG. 1) is freely mounted on the board 17 so as to contact the disks 20 and 21 with its outer surface.

The disk 34 (FIG. 2) corresponding to the first intermediate roll 4 (FIG. 1) is freely mounted on the board 17 so as to contact the disks 32, 33 and 35.

The entire system of disks positioned on the board 17 corresponds to the disposition and operational relationship of the rolls in the rolling mill and is capable of relative displacement in the plane of the board 17 as a result of turning the eccentric disks 20 and 21.

In addition, the distance between the surface of the disk 35 and the horizontal bar 19 is kept under control, this distance simulating the distance between the working roll 3 (FIG. 1) and the pass line X of the rolling mill which may be checked with the help of any suitable measuring instrument, such as an indicator shown at 36.

The process of selecting the sets of rolls consists of positioning the disks 20 and 21 (FIG. 2) with their marks 28 and 29 against the zero marks of the scales 30 and 31.

Such a position of the disks 20, 21 corresponds to the extreme position of the backup rolls C and D (FIG. 1), when the roll train of the rolling mill is extended to the maximum. For example, there is a prepared set of rolls for the rolling mill and it is necessary to determine whether or not this set is ready to ensure the required processing gap between the working rolls 3 (FIG. 1) of the rolling mill. To give an answer it is not at all obligatory to install the prepared set of rolls on the rolling mill. It is sufficient to choose from the combination of disks those disks whose diameters correspond to the diameters of the rolls to be replaced, position said disks on the board 17 (FIG. 2) in compliance with the positioning of the respective rolls in the rolling mill and using the indicator 36, determine the amount of the processing gap enabling a blank to pass between the disk 35 and the pass line X. Then, the disks 20, 21 should be turned around the centers 22 and 23 to the position where the disk 35 comes in contact with the pass line X. Should this requirement be met, the set of rolls is suitable for replacement. In the case where this requirement is not met, one of the types of disks should be replaced for one of larger or smaller diameter and the gap obtained between the disk 35 and the pass line X should be again checked for suitability.

Should the above requirement be met, real rolls are selected according to the diameters of the disks and then installed in the rolling mill.

If the selected disks fall to ensure the required gap between the disk 35 and the pass line X, the above-described procedure should be repeated until the optimum diameters of disks are found and the respective rolls for the rolling mill are selected.

This affords quick selection of sets of rolls before their installation in rolling mills without the waste of time and labor for remedying faults caused by a wrong selection of sets of rolls to be installed in rolling mills.

What we claim is:

1. A device for selecting sets of rolls for a twenty-high rolling mill, said device being a model of said mill, comprising: a flat board; eccentric disks installed on said board in full conformity with the positioning of backup rolls of a rolling mill and being rotatable in the plane of said board, the dimensions of said disks corresponding to the dimensions of the backup rolls of the rolling mill; a vertical guide member secured on said board and adapted for disks corresponding working and idle rolls to traverse therealong; a horizontal bar corresponding to the pass line of the rolling mill, with respect to which the position of the working roll is determined; other disks installed on said board in conformity with the positioning of intermediate and drive rolls in the rolling mill, said model thus forming a two-dimensional model of the roll arrangement in the rolling mill, so that by varying the position of said disks corresponding to the backup rolls, it is possible to select the dimensions of the remaining rolls to provide the required processing gap between the working rolls of the rolling mill.

2. A device for selecting sets of rolls for a twenty-high rolling mill as set forth in claim 1, wherein said model is an one-fourth portion of the roll arrangement of said rolling mill.

* * * * *